US005275113A

United States Patent [19]

Schwendt

[11] Patent Number: 5,275,113

[45] Date of Patent: Jan. 4, 1994

[54] VEHICLE DRIVEN ON RAILS

[75] Inventor: Lutz Schwendt, Vellmar, Fed. Rep. of Germany

[73] Assignee: ABB Patent GmbH, Mannheim, Fed. Rep. of Germany

[21] Appl. No.: 975,659

[22] Filed: Nov. 13, 1992

[30] Foreign Application Priority Data

Nov. 13, 1991 [DE] Fed. Rep. of Germany ..... 4137235

[51] Int. Cl.[5] ..... B61F 5/00

[52] U.S. Cl. ..... 105/199.4; 105/133; 105/138; 105/157.1; 105/185; 105/193; 105/207

[58] Field of Search ..... 105/157.1, 133, 135, 105/136, 137, 138, 139, 49, 174, 185, 187, 189, 190.1, 190.2, 193, 199.4, 207

[56] References Cited

U.S. PATENT DOCUMENTS

| | | | |
|---|---|---|---|
| 424,373 | 3/1890 | Stephenson | 105/138 |
| 825,035 | 7/1906 | Dodds | 105/207 |
| 927,497 | 7/1909 | Dailey | 105/207 |
| 994,093 | 5/1911 | Covert | 105/207 |
| 1,704,452 | 3/1929 | Whipps | 105/138 |
| 1,962,893 | 6/1934 | Christianson | 105/138 |
| 2,036,194 | 4/1936 | Burrows et al. | 105/135 |
| 2,198,668 | 4/1940 | Janeway | 105/199.4 |
| 2,630,079 | 3/1953 | Cottrell | 105/193 |
| 2,976,819 | 3/1961 | Ross et al. | 105/138 |
| 3,200,769 | 8/1965 | Dobson et al. | 105/138 |
| 4,787,318 | 11/1988 | Vogel | 105/136 |

FOREIGN PATENT DOCUMENTS

| | | | |
|---|---|---|---|
| 862617 | 11/1952 | Fed. Rep. of Germany . | |
| 1455033 | 3/1969 | Fed. Rep. of Germany . | |
| 1675082 | 12/1970 | Fed. Rep. of Germany | 105/199.4 |
| 0836307 | 10/1938 | France | 105/193 |
| 2331470 | 6/1977 | France . | |
| 0330020 | 6/1958 | Switzerland | 105/138 |
| 0442104 | 12/1974 | U.S.S.R. | 105/133 |

*Primary Examiner*—Mark T. Le

*Attorney, Agent, or Firm*—Herbert L. Lerner; Laurence A. Greenberg

[57] ABSTRACT

A vehicle driven on rails includes a vehicle frame, a wheel set, a pivotable truck and at least one drive unit being disposed in the pivotable truck for acting upon the wheel set. An intermediate support is connected to the pivotable truck and to the drive unit. The intermediate support is also connected to the vehicle frame, such as by a threaded spindle connecting the vehicle frame to the intermediate support during assembly.

14 Claims, 1 Drawing Sheet

VEHICLE DRIVEN ON RAILS

Figure 1:
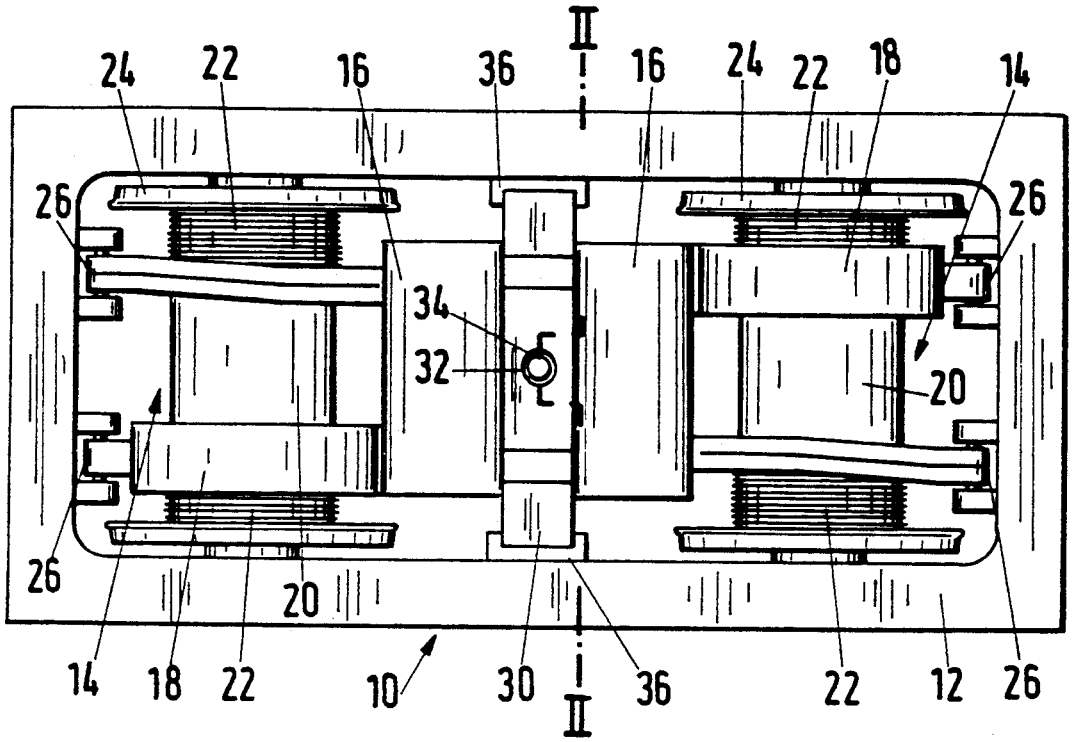

The invention relates to a vehicle driven on rails, having a vehicle frame and at least one drive unit disposed in a truck f or acting upon a wheel set, the truck and the drive unit being connected to the vehicle frame.

In vehicles driven on rails it is known to place the drive units in pivotable trucks or bogies. It is typical for each wheel set to be acted upon by one drive unit.

German Patent DE-PS 28 22 992 discloses a vehicle driven on rails having a drive unit disposed in a pivotable truck or bogie frame of a pivotable truck or bogie, and a vehicle frame supported on it. The drive unit is provided for acting upon a wheel set. The drive unit, which is formed of a drive motor and of a step-up transmission, is secured by a three-point suspension. Two suspension points are provided on the pivotable truck or bogie frame and a third suspension point is provided directly on the vehicle frame. Suspending the drive unit in such a way has proven itself during use over time, but when maintenance work is done, it has been found that such a direct suspension of the drive unit from the vehicle frame, which was chosen for the sake of stability in operation, entails additional assembly work if dismantling the vehicle frame from the pivotable truck or bogie becomes necessary.

It proves to be indispensable for the drives, which are initially secured to the vehicle frame, to be supported after the connection has been undone. At the same time, the spring travel of the suspension system, which is relieved as a result, must be limited.

In the known type of the connection of the pivotable truck or bogie and the drive unit to the associated vehicle frame, successive work is necessary. The support springs supported on the pivotable truck or bogie relax and in so doing push the vehicle frame or vehicle box away, to the same extent as the undoing of the suspension of the drive unit from the vehicle frame and because of the resultant relief. The support for the drive unit must accordingly be readjusted repeatedly.

It is accordingly an object of the invention to provide a vehicle driven on rails, which overcomes the hereinafore-mentioned disadvantages of the heretofore-known devices of this general type and which has an apparatus for connection between the vehicle frame and the pivotable truck or bogie that is simple in structure and is easily manipulated during maintenance work and during the lifting of the vehicle frame from the pivotable truck or bogie which is accordingly necessary.

With the foregoing and other objects in view there is provided, in accordance with the invention, a vehicle driven on rails, comprising a vehicle frame, a wheel set, a pivotable truck, at least one drive unit being disposed in the pivotable truck for acting upon the wheel set, and an intermediate support connecting the vehicle frame to the pivotable truck and to the drive unit.

Accordingly, there is provided an intermediate support connected to the vehicle frame, with which the drive units of one pivotable truck or bogie are connected.

With the objects of the invention in view, there is also provided a vehicle driven on rails, comprising a vehicle frame, a wheel set, a pivotable truck, at least one drive unit being disposed in the pivotable truck for acting upon the wheel set, an intermediate support connected to the pivotable truck and to the drive unit, and a threaded spindle connecting the vehicle frame to the intermediate support during assembly.

During the assembly, the intermediate support is connected to the vehicle frame by the threaded spindle to be screwed in, so that the connection between the intermediate support and the vehicle frame, which exists during operation and must be undone during disassembly, is bypassed.

Thus the connection of the vehicle frame with the drive unit can be undone during operation, independently of the motions of the vehicle frame resulting from the relief of the springs. Subsequently, the intermediate support is lowered onto the pivotable truck or bogie by means of the threaded spindle and the vehicle frame can then be raised.

A further considerable advantage of the intermediate support of the invention is that the horizontal shock absorbers between the pivotable truck or bogie and the vehicle frame are secured to the intermediate support, rather than to the vehicle frame, so that they no longer need to be undone when the vehicle frame is lifted from the pivotable truck or bogie. The same is true for the so-called emergency pivotable truck or bogie suspension, which is likewise attained by a suitable structure of the intermediate support, and as a result no additional work is necessary for this provision either.

In accordance with another feature of the invention, the pivotable truck has a pivotable truck frame with a protrusion formed thereon, and the intermediate support has a retaining element cooperating with the protrusion and acting as a vertical stop for the vehicle frame relative to the pivotable truck.

In accordance with a further feature of the invention, the retaining element has a rib being disposed on the intermediate support and serving as a transverse stop for the vehicle frame on the pivotable truck frame.

In accordance with an added feature of the invention, the retaining element is formed onto the intermediate support and serves as an emergency suspension and as a lifting point for the pivotable truck on the vehicle frame.

In accordance with a concomitant feature of the invention, there are provided vibration dampers for damping vibration between the pivotable truck frame and the vehicle frame, the retaining element being formed onto the intermediate support and serving as a fastening for the transversely disposed vibration dampers.

Therefore, the intermediate support according to the invention is used simultaneously as both a vertical stop for the pivotable truck or bogie and a transverse stop for the vehicle frame on the pivotable truck or bogie frame.

Before the vehicle frame is set on the pivotable truck or bogie and connected to it, the intermediate support rests on the pivotable truck or bogie frame.

The intermediate support simultaneously carries the transverse stops, toward the vehicle frame, between the pivotable truck or bogie and the vehicle frame.

Other features which are considered as characteristic for the invention are set forth in the appended claims.

Although the invention is illustrated and described herein as embodied in a vehicle driven on rails, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
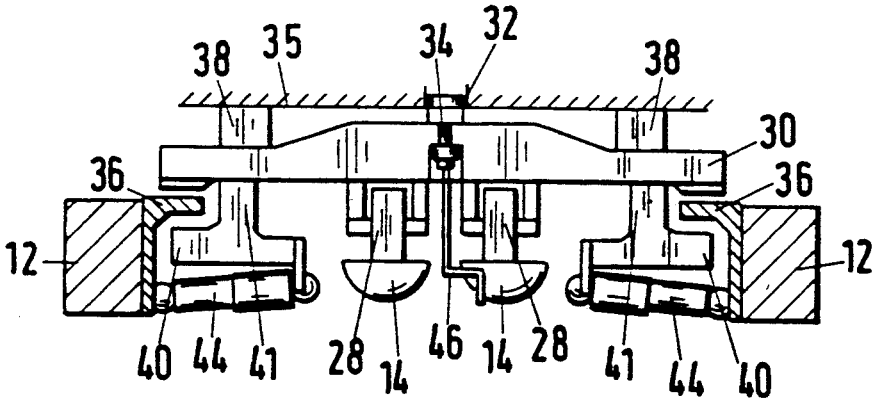

FIG. 1 is a diagrammatic, top-plan view of a pivotable truck or bogie with an intermediate support; and FIG. 2 is a fragmentary, cross-sectional view taken along the line II—II of FIG. 1.

Referring now to the FIGURES of the drawing in detail and first, particularly, to FIG. 1 thereof, there is seen a pivotable truck or bogie 10 with a pivotable truck or bogie frame 12 and two drive units 14, disposed in mirror symmetry relative to one another in the frame 12. Each of the drive units 14 includes one drive motor 16, one transmission 18, and one hollow coupling shaft 20. Each of the hollow coupling shafts 20 is connected to one wheel set 24 through respective flexible rubber couplings 22.

Fastening points 26 for fastening each of the drive units 14 are provided on the pivotable truck or bogie frame 12.

One further fastening point 28 for fastening each of the drive units 14 is provided on an intermediate support 30. The intermediate support 30 is disposed crosswise above the pivotable truck or bogie frame 12, approximately halfway along its length.

The intermediate support 30 is preferably constructed as a welded frame profile, with a centrally disposed recess 32 extending vertically through its center of gravity. As is shown in further detail in FIG. 2, a threaded spindle 34 can be passed through the recess 32 for fastening to a vehicle frame 35.

Protrusions 36, which serve as a vertical stop for the intermediate support 30 toward the pivotable truck or bogie 10, are disposed on inner surfaces of the pivotable truck or bogie frame 12, adjacent the intermediate support 30.

As is also shown in the cross-sectional view of FIG. 2, the intermediate support 30 is connected to the diagrammatically illustrated vehicle frame 35 by spacer elements 38.

T-shaped retaining elements or pieces 40 are formed onto the lower surface of the intermediate support 30 and point toward the pivotable truck or bogie 10. The retaining pieces 40 serve on one hand as a lifting point or emergency suspension for the pivotable truck or bogie 10 on the vehicle frame 35 and on the other hand as a transverse stop for the vehicle frame 35 with the pivotable truck or bogie frame 12. In the case of the latter function, bent ends of the formed-on protrusions 36 on the pivotable truck or bogie frame 12 serve as limiting buffers, which strike a rib 41 protruding at right angles from the intermediate support 30, upon suitable deflection of the pivotable truck or bogie.

A retaining device for one end of a vibration damper 44 is provided on an inwardly pointing end of a transverse flange of the retaining element 40. The vibration damper 44 has another end that engages the pivotable truck or bogie frame 12. The vibration damper 44 serves to damp transverse vibration between the pivotable truck or bogie 10 and the intermediate support 30 on one hand and between the pivotable truck or bogie 10 and the vehicle frame 35 on the other hand.

The threaded spindle 34 can be actuated with a crank 46 shown in FIG. 2. Instead of the hand crank 46, a non-illustrated, motor-driven turning device may be used in order to actuate the threaded spindle 34 for connecting the intermediate support 30 to the vehicle frame 35.

The elements of the invention are intended to cooperate as follows:

The intermediate support 30 is fixed vertically on the vehicle frame 35 by the threaded spindle 34, which is actuated by means of the crank or turning device 46, in order to make it possible to undo the connection provided by the spacer elements 38, without hindrance from non-illustrated relaxing vehicle springs.

Once the connections 38 have been undone, the intermediate support 30, with the drive units 14 located on it, can be lowered onto the pivotable truck or bogie 10 by unscrewing the threaded spindle 34. At the same time, raising of the vehicle frame 35 is effected by the non-illustrated springs, which are relieved of the weight of the drives and relax in the process, which is expressed by a corresponding spring travel.

I claim:

1. A vehicle driven on rails, comprising a vehicle frame, a wheel set, a pivotable truck, at least one drive unit with a motor disposed in said pivotable truck for acting upon said wheel set, and intermediate support connecting said vehicle frame to said pivotable truck and directly supporting to said drive unit, and means in the form of a threaded spindle disposed at said vehicle frame and said intermediate support for connecting said vehicle frame to said intermediate support during assembly and for lowering said intermediate support onto said pivotable truck when said vehicle frame is lifted from said intermediate support.

2. The vehicle driven on rails according to claim 1, wherein said pivotable truck has a pivotable truck frame with a protrusion formed thereon, and said intermediate support has a retaining element cooperating with said protrusion and acting as a vertical stop for said vehicle frame relative to said pivotable truck.

3. The vehicle driven on rails according to claim 2, wherein said retaining element has a rib being disposed on said intermediate support and serving as a transverse stop for said vehicle frame on said pivotable truck frame.

4. The vehicle driven on rails according to claim 3, wherein said retaining element is formed onto said intermediate support and serves as an emergency suspension and as a lifting point for said pivotable truck on said vehicle frame.

5. The vehicle driven on rails according to claim 2, including vibration dampers for damping vibration between said pivotable truck frame and said vehicle frame, said retaining element being formed onto said intermediate support and serving as a fastening for said transversely disposed vibration dampers.

6. The vehicle driven on rails according to claim 3, including vibration dampers for damping vibration between said pivotable truck frame and said vehicle frame, said retaining element being formed onto said intermediate support and serving as a fastening for said transversely disposed vibration dampers.

7. The vehicle driven on rails according to claim 4, including vibration dampers for damping vibration between said pivotable truck frame and said vehicle frame, said retaining element being formed onto said intermediate support and serving as a fastening for said transversely disposed vibration dampers.

8. A vehicle driven on rails, comprising a vehicle frame, a wheel set, a pivotable truck, at least one drive unit with a motor being disposed in said pivotable truck for acting upon said wheel set, an intermediate support connected to said pivotable truck and directly supporting said drive unit, and a threaded spindle connecting said vehicle frame to said intermediate support during assembly.

9. The vehicle driven on rails according to claim 8, wherein said pivotable truck has a pivotable truck frame with a protrusion formed thereon, and said intermediate support has a retaining element cooperating with said protrusion and acting as a vertical stop for said vehicle frame relative to said pivotable truck.

10. The vehicle driven on rails according to claim 9, wherein said retaining element has a rib being disposed on said intermediate support and serving as a transverse stop for said vehicle frame on said pivotable truck frame.

11. The vehicle driven on rails according to claim 10, wherein said retaining element is formed onto said intermediate support and serves as an emergency suspension and as a lifting point for said pivotable truck on said vehicle frame.

12. The vehicle driven on rails according to claim 9, including vibration dampers for damping vibration between said pivotable truck frame and said vehicle frame, said retaining element being formed onto said intermediate support and serving as a fastening for said transversely disposed vibration dampers.

13. The vehicle driven on rails according to claim 10, including vibration dampers for damping vibration between said pivotable truck frame and said vehicle frame, said retaining element being formed onto said intermediate support and serving as a fastening for said transversely disposed vibration dampers.

14. The vehicle driven on rails according to claim 11, including vibration dampers for damping vibration between said pivotable truck frame and said vehicle frame, said retaining element being formed onto said intermediate support and serving as a fastening for said transversely disposed vibration dampers.

* * * * *